US008739371B2

(12) United States Patent
Fiedler

(10) Patent No.: US 8,739,371 B2
(45) Date of Patent: Jun. 3, 2014

(54) LOCKING DEVICE

(75) Inventor: Joachim Fiedler, Hannover (DE)

(73) Assignee: Fidlock GmbH, Hannover (DE)

( * ) Notice: Subject to any disclaimer, the term of this patent is extended or adjusted under 35 U.S.C. 154(b) by 114 days.

(21) Appl. No.: 13/298,787

(22) Filed: Nov. 17, 2011

(65) Prior Publication Data

US 2012/0124786 A1 May 24, 2012

(30) Foreign Application Priority Data

Nov. 18, 2010 (DE) ..... 10 2010 044 144

(51) Int. Cl.
*A44B 99/00* (2010.01)
*A45C 13/00* (2006.01)

(52) U.S. Cl.
USPC ..... 24/303

(58) Field of Classification Search
USPC ..... 24/303
See application file for complete search history.

(56) References Cited

U.S. PATENT DOCUMENTS 5,092,019 A * 3/1992 Levy ..... 24/303
5,317,789 A * 6/1994 Levy ..... 24/303
6,135,515 A * 10/2000 Roth et al. ..... 292/251.5
6,182,336 B1 * 2/2001 Bauer ..... 24/303
6,631,629 B1 * 10/2003 Fuss et al. ..... 70/57.1
6,912,878 B2 * 7/2005 Belden, Jr. ..... 70/57.1
2004/0189017 A1 * 9/2004 Chen et al. ..... 292/251.5
2008/0001696 A1 1/2008 Coulson et al.
2009/0211065 A1 * 8/2009 Moerke ..... 24/303
2010/0308605 A1 12/2010 Fiedler
2011/0001025 A1 1/2011 Fiedler

FOREIGN PATENT DOCUMENTS

DE 19621003 A1 11/1997
DE 102007058188 A1 10/2009
GB 1530591 11/1978
WO 2009092368 A2 7/2009

* cited by examiner

*Primary Examiner* — Robert J Sandy
*Assistant Examiner* — David Upchurch
(74) *Attorney, Agent, or Firm* — The Webb Law Firm

(57) ABSTRACT

Disclosed is a locking device, including a first locking part, having a casing and a blocking piece arranged on the casing, a second locking part, having a spring lock element which is formed spring-elastic at least in sections, and magnetic means, which act between the blocking piece of the first locking part and the second locking part and cause a magnetic force between the blocking piece of the first locking part and the second locking part. To close the locking device the first locking part can be attached onto the second locking part in a closing direction. To release the locking device the spring lock element can be slid in an opening direction directed essentially lateral to the closing direction relative to the blocking piece.

10 Claims, 12 Drawing Sheets

LOCKING DEVICE

CROSS-REFERENCE TO RELATED APPLICATION

This application claims priority of German Patent Application Number 10 2010 044 144.9, filed Nov. 18, 2010.

BACKGROUND OF THE INVENTION

The invention relates to a locking device.

Such a locking device has a first locking part, comprising a casing and a blocking piece arranged on the casing, a second locking part, comprising a spring lock element which is formed spring-elastic at least in sections, and magnetic means, which act between the blocking piece of the first locking part and the second locking part and cause a magnetic force between the blocking piece of the first locking part and the second locking part. To close the locking device, the first locking part is attached in a closing direction onto the second locking part, wherein the closing process, due to the magnetic force of the magnetic means between the blocking piece of the first locking part and the second locking part, is assisted magnetically. In a closing position, then, the blocking piece and the spring lock element engage with each other, so that the locking part is locked counter to the closing direction against the second locking part. The blocking piece and the spring lock element, thus, in the closing position form a positive lock counter to the closing direction, so that the blocking piece in the closing position is held lockingly on the spring lock element. To release the locking device, the spring lock element is slid in an opening direction essentially directed across to the closing direction relative to the blocking piece, to, in this manner, disengage the spring lock element and the blocking piece.

In such a locking device, as it is known for example from the WO 2009/092368 A2, the closing takes place in a magnetically assisted manner, in that attaching the first locking part onto the second locking part and lockingly engaging the blocking piece with the spring lock element is assisted magnetically. To lock the locking device the first locking part is attached in the closing direction onto the second locking part and thus a locking engagement between the blocking piece and the spring lock element is established. To open, the spring lock element is moved by moving the second locking part or at least a part of the second locking part in the opening direction essentially across to the closing direction approximatively straight, so that in this manner the blocking piece disengages from the spring lock element and the first locking part can be removed from the second locking part.

A locking device of this kind can be employed in various ways to connect two components to each other, wherein one of the components is connected to the first locking part and the other one of the components is connected to the second locking part and, via the engaging lock of the locking parts with each other, the components are coupled with each other in a secure, detachable manner.

Locking devices of this kind in their closing position provide a secure, enduring connection of two parts to each other and can be closed in a simple manner and can be reopened in a haptically pleasant manner. The possible applications of such locking devices extend to devices of a general kind for the (detachable) connection of two components, such as locks of bags, flaps or covers, connecting devices for straps or cords or also entirely different components.

In the locking device of the WO 2009/092368 A2 the blocking piece of the first locking part projects from the casing of the first locking part to be able to establish an engagement of the blocking piece of the first locking part with the spring lock element of the second locking part, but it can, thus, be unattractive and obstructive in the opened locking device.

SUMMARY OF THE INVENTION

It is the object of the present invention to provide a locking device, in which the blocking piece in an opened position of the locking device is, if possible, not obstructing the use of a component which is connected to the first locking part.

According to an exemplary embodiment of the invention it is provided that the blocking piece is arranged movably on the casing of the first locking part in such a way that in a retracted position it is enclosed at least partially in a housing chamber of the casing and in an extended position it projects from the casing in such a way that it can be brought into engagement with the spring lock element.

The present invention is based on the idea to arrange the blocking piece movably on the casing of the first locking part. In a retracted position the blocking piece is largely arranged in the casing and thus does not or at least not completely project from the casing. In an opened position of the locking device the blocking piece is positioned in the retracted position and is thus not obstructing or disturbing the use of a component which is connected to the first locking part. Upon closing the locking device the blocking piece is transferred from its retracted position into the extended position and in this extended position projects from the casing in such a way that it can be brought into engagement with the spring lock element and thus can be lockingly attached onto the spring lock element for locking the first locking part with the second locking part.

Transferring the blocking piece from the retracted position into the extended position best takes place automatically by the effect of the magnetic means, which act between the blocking piece and the second locking part in a magnetic manner. When the first locking part is attached onto the second locking part, the magnetic means create a magnetic force between the blocking piece on the first locking part and the second locking part and transfer the blocking piece from its retracted position into the extended position, so that the blocking piece engages mechanically with the spring lock element and the locking device can in this manner be locked.

The magnetic means can for example be formed by two (permanent) magnets, one of which is arranged on the blocking piece and the other on the second locking part. It is also conceivable, however, to provide on the one of blocking piece and second locking part a magnet and on the other of blocking piece and second locking part a magnetic anchor made of ferromagnetic material, for example iron.

Advantageously the magnetic means are dimensioned in such a way that upon attaching the first locking part onto the second locking part the blocking piece is held in the extended position to lockingly engage the blocking piece with the spring lock element. The background is here that upon attaching the blocking piece onto the spring lock element the blocking piece pushes aside the spring lock element in an elastic manner, to bring the blocking piece with a catch section into a positive-locking engagement with a corresponding catch section on the spring lock element. The force required to push away the spring lock element should herein be smaller than the magnetic force of the magnetic means, so that upon the locking engagement the blocking piece is held in its extended position and is not pushed into its retracted position due to the force required to establish the locking engagement.

To automatically return the blocking piece into its retracted position after the opening of the locking device, it can be provided to pre-stress the blocking piece against the casing of the first locking part in the direction of the retracted position. For this purpose separate magnetic pre-stressing means can be provided, which act between the blocking piece and the casing of the first locking part and exert a magnetic force on the blocking piece in the direction of the retracted position. This magnetic force should herein, at least when the first locking part is brought sufficiently close enough to the second locking part, be smaller than the magnetic force of the magnetic means acting between the blocking piece and the second locking part, so that these magnetic means, upon attaching the first locking part onto the second locking part, can transfer the blocking piece into its extended position in a reliable manner.

The pre-stressing can also be caused by a mechanical spring, which acts between the blocking piece and the casing of the first locking part and returns the blocking piece into its retracted position after the opening of the locking device.

An adjustment element can be provided on the second locking part, mounted slidable on a casing of the second locking part along the opening direction. The spring lock element is arranged on this adjustment element, so that by actuating the adjustment element the spring lock element can be moved relative to the blocking piece of the first locking part. In the closing position the spring lock element engages with the blocking piece, so that the first locking part is held on the second locking part. To open the locking device the adjustment element can then be actuated in such a way that the spring lock element is moved relative to the blocking piece and disengages from the blocking piece.

This adjustment element can for example be formed as a kind of sledge and be mounted on the casing of the second locking part, wherein the adjustment element is adjustable relative to the casing in the direction of the opening direction, and by actuating the adjustment element the spring lock element is moved relative to the casing. Opening the locking device thus takes place not by a movement of the second locking part altogether, but by actuating the adjustment element of the second locking part, on account of which the engagement between the blocking piece and the spring lock element is released and the first locking part can be taken out from the second locking part.

The magnetic means in this case advantageously act between the blocking piece of the first locking part and the adjustment element of the second locking part, so that the magnetic means also exert a force on the adjustment element in such a way that the adjustment element, due to the magnetic force between the blocking piece and the adjustment element, upon attaching the first locking part onto the second locking part is adjusted in such a position, in which the blocking piece can be brought into engagement with the spring lock element.

The spring lock element advantageously extends in a circumferential direction around the closing direction and is, for example, formed as a strip, which is elastic at least in sections and bent around the closing direction, on which a catch section is arranged for the locking engagement with a corresponding catch section on the blocking piece. In the closing position the spring lock element encompasses the blocking piece in the circumferential direction at least in sections, so that the blocking piece is held on the spring lock element by this encompassing.

The spring lock element is in sections opened circumferentially in the opening direction, so that the blocking piece can be released from the encompassing with the spring lock element by a relative movement between the spring lock element and the blocking piece.

To attach the blocking piece onto the spring lock element to lock the first locking part relative to the second locking part, the blocking piece is thus attached onto the spring lock element in the closing direction and herein pushes aside the spring lock element in an elastic manner in the direction of an expanding across to the closing direction, so that the spring lock element engages lockingly with the blocking piece and encompasses the blocking piece in a locking engagement position along the circumferential direction. To release, the spring lock element is then moved in the opening direction relative to the blocking piece, so that the blocking piece disengages from the spring lock element by a relative movement across to the closing direction.

BRIEF DESCRIPTION OF THE DRAWINGS

The idea underlying the invention shall subsequently be further explained with the help of the exemplary embodiments illustrated in the figures. In the figures.

DETAILED DESCRIPTION OF THE INVENTION

Figure 1:
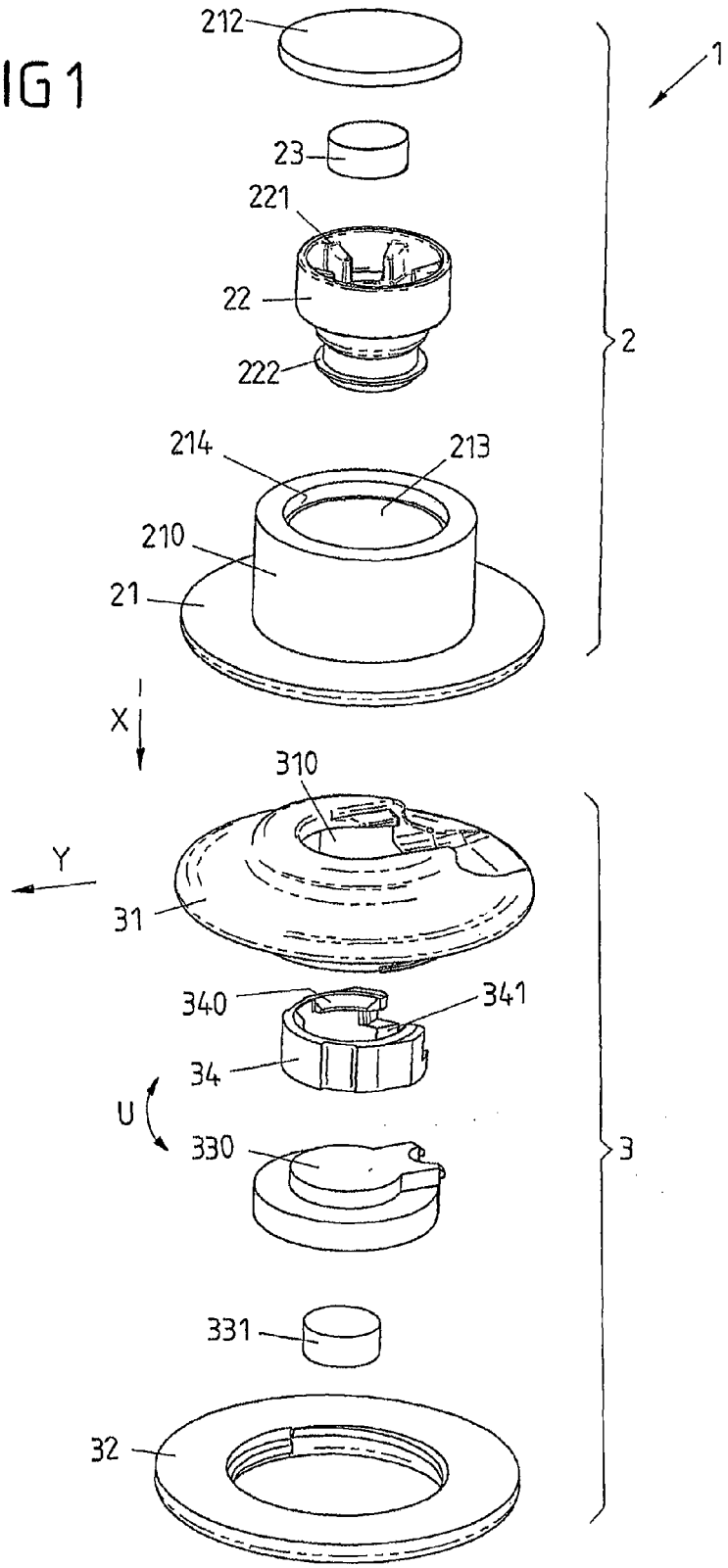
FIG. 1 shows an exploded view of a locking device.
Figure 2:
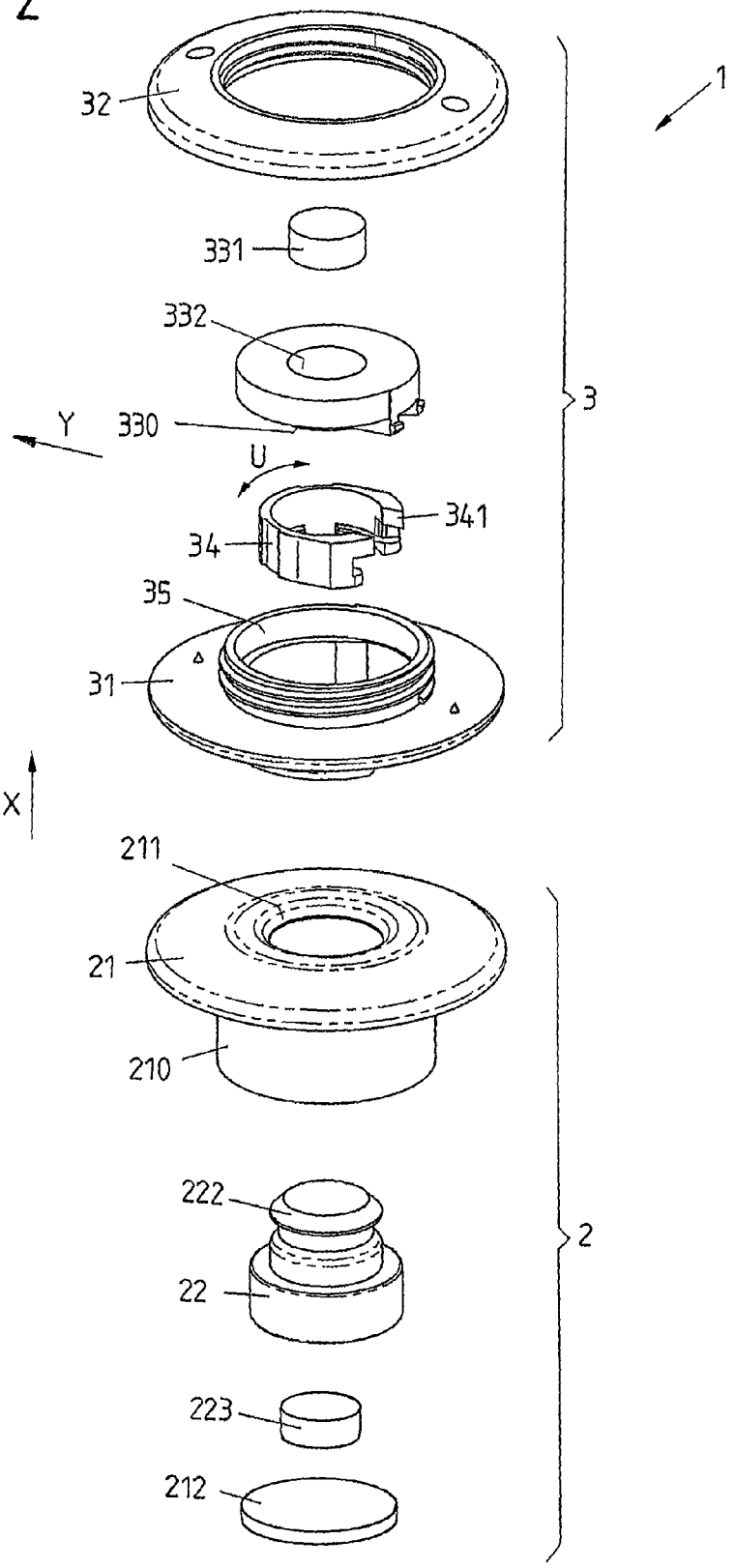
FIG. 2 shows an exploded view of the locking device according to FIG. 1, viewed from a different perspective.

A first exemplary embodiment of a locking device 1, illustrated in FIGS. 1 to 6, has a first locking part 2 and a second locking part 3, which in an opened position exist separately from each other, which, to close, can be attached onto each other in a closing direction X and are locked with each other in a closing position.

The first locking part 2 comprises a casing 21 with a casing section 210, enclosing a housing chamber 213. In this housing chamber 213 a blocking piece 22 is arranged slidable.

The second locking part 3 comprises a casing 31, onto which a casing part 32 is attached. A holding section 330 is arranged on the casing 31, which holds a spring lock element 34 torque-proof on a housing opening 310 of the casing 31.

Upon using the locking device 1 for example for the closing of a bag, a section of a bag cover can be held tucked between the casing 31 and the casing part 32.

The blocking piece 22, arranged on the casing 21 of the first locking part 2, and the spring lock element 34, arranged on the casing 31 of the second locking part 3 serve for the mechanical locking of the first locking part 2 with the second locking part 3 in a closing position. The blocking piece 22 and the spring lock element 34 for this purpose each have one or multiple catch sections 222 or 340, which, for the locking of the first locking part 2 with the second locking part 3, can be brought into locking engagement with each other and in the closing position cause a positive-locking connection of the blocking piece 22 to the spring lock element 34.

The first locking part 2 can be attached in a closing direction X onto the second locking part 3, to transfer the locking device 1 into its closing position, as shall yet be subsequently explained in detail with the help of FIGS. 3 to 6. The spring lock element 34 herein extends along a circumferential direction U around the closing direction X and is in sections opened circumferentially by an opening 341. This has the effect that the blocking piece 22 can on the one hand in a comparably simple manner without great effort be attached in the closing direction X onto the spring lock element 34, in that the blocking piece 22 with its catch section 222 (circulating the blocking piece 22 circumferentially) is attached in the closing direction X onto the catch section 340 of the spring lock element 34 and hereby expands the spring lock element 34 across to the closing direction X, so that the catch section 222 of the blocking piece 22 lockingly engages with the catch section 340 of the spring lock element 34.

To open, the spring lock element 34 is slid in an opening direction Y, essentially directed across to the closing direction X, relative to the blocking piece 22 so that the blocking piece 22 is led through the circumferential opening 341 on the spring lock element 34 and disengages from the spring lock element 34.

Figure 3A:
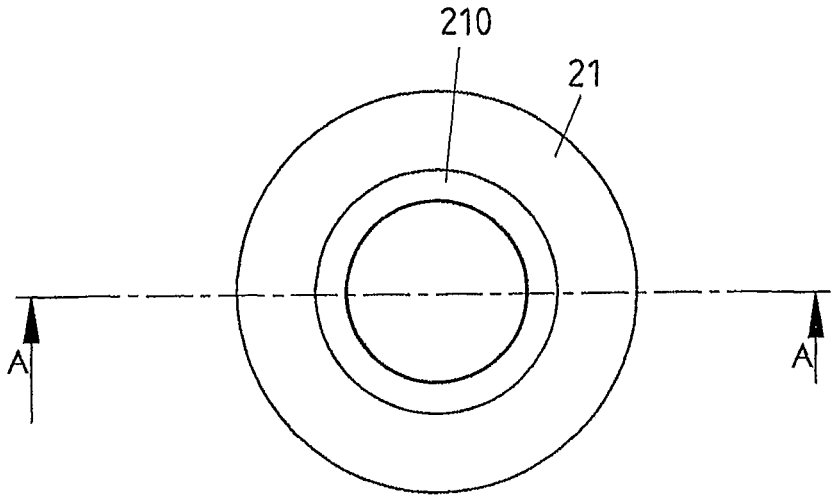
FIG. 3A shows a top view of the locking device prior to closing.
Figure 3B:
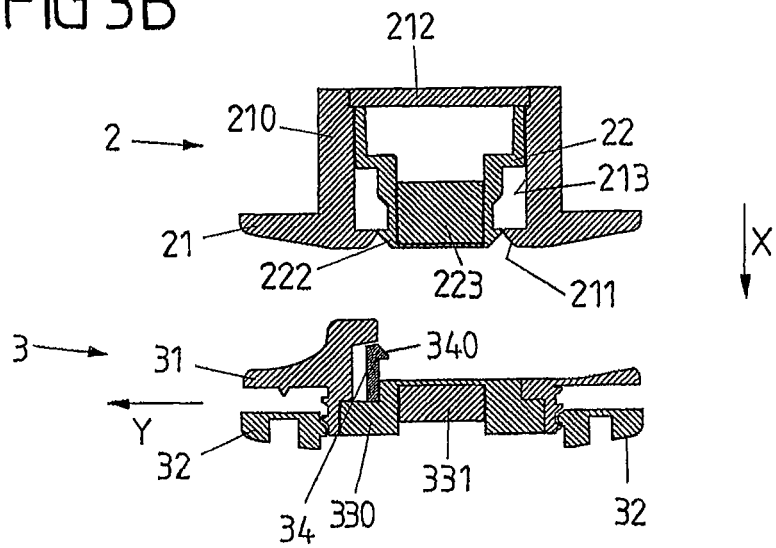
FIG. 3B shows a sectional view of the arrangement according to FIG. 3A along the line A-A.

FIGS. 3A and 3B show the locking device 1 prior to the closing of the locking device 1. In this state the blocking piece 22 is retracted into the housing chamber 213 of the casing 21 and is thus positioned in a retracted state in which it does not project outwards from the casing 21. A magnet 212 is arranged on a housing opening 214 of the casing section 210 (see FIG. 1), which stands magnetically attracting opposite to a magnet 223 of the blocking piece 22 (see FIG. 3B). On account of the magnetic force between the magnets 212, 223, the blocking piece 22 is in the opened position of the locking device 1 at first held in its retracted position.

Figure 4A:
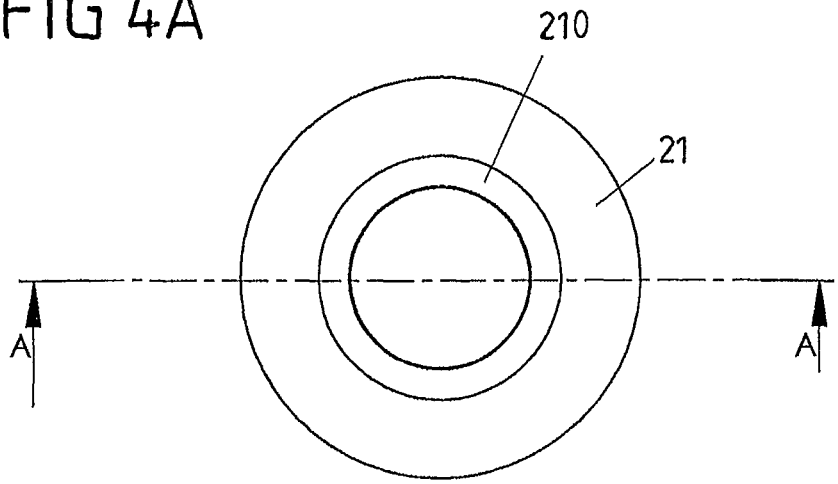
FIG. 4A shows a top view of the locking device prior to closing.
Figure 4B:
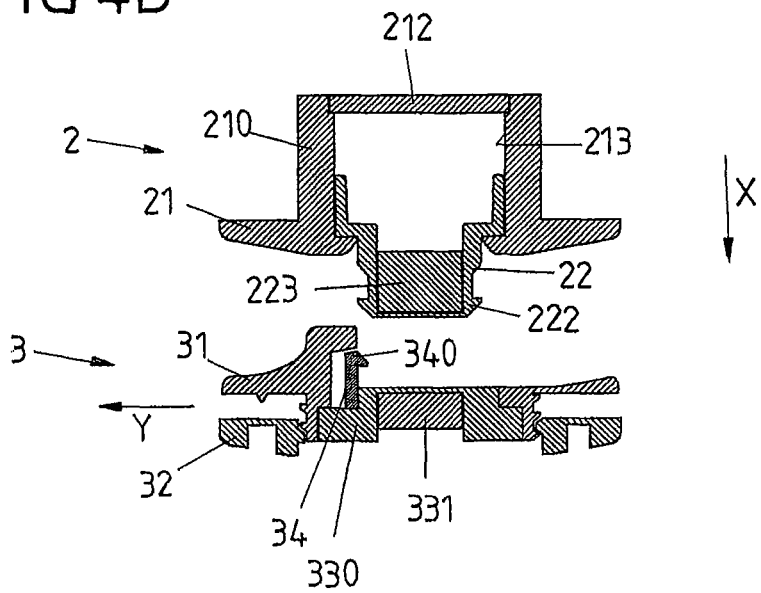
FIG. 4B shows a sectional view of the arrangement according to FIG. 4A along the line A-A.

When, as illustrated in FIGS. 4A and 4B, the first locking part 2 is in the closing direction X brought close to the second locking part 3, the blocking piece 22 is transferred from its retracted position into an extended position, as illustrated in FIG. 4B. This takes place in an automatic manner due to a magnetic force between the magnet 223, arranged on the blocking piece 22, and a magnet 331, arranged on the holding section 330 on the casing 31 of the second locking part 3.

In the extended position the blocking piece 22 extends through an opening 211 on the casing 21 and projects outwards from the casing 21. The blocking piece 22 in this case lies against the edge section of the opening 211, which confines the housing chamber 213 in the closing direction X, so that an end position for the extended position is defined by the edge of the opening 211.

The magnets 223, 331 realize magnetic means for creating a magnetic force between the blocking piece 22 and the second locking part 3 and fulfil two kinds of functions. For one thing, the magnetic means 223, 331 have the effect that the blocking piece 22, upon attaching the first locking part 2 onto the second locking part 3, is transferred from its retracted position (see FIG. 3B) into its extended position (see FIG. 4B). For another, the magnetic means 223, 331 create a magnetic force, which magnetically assists in the closing of the locking device 1 and pulls the blocking piece 22 into engagement with the spring lock element 34, so that the mechanical locking engagement of the blocking piece 22 with the spring lock element 34 can be established in a largely automatic manner, when the magnets 223, 331 are suitably dimensioned.

The magnetic means in the form of the magnets 223, 331 are dimensioned in such a way, that upon attaching the blocking piece 22 onto the spring lock element 34 the blocking piece 22 is not returned into its retracted position, but the catch section 222 of the blocking piece 22 engages with the catch section 340 of the spring lock element 34 and for this purpose can push aside the spring lock element 34 in the direction of an expanding.

Figure 5A:
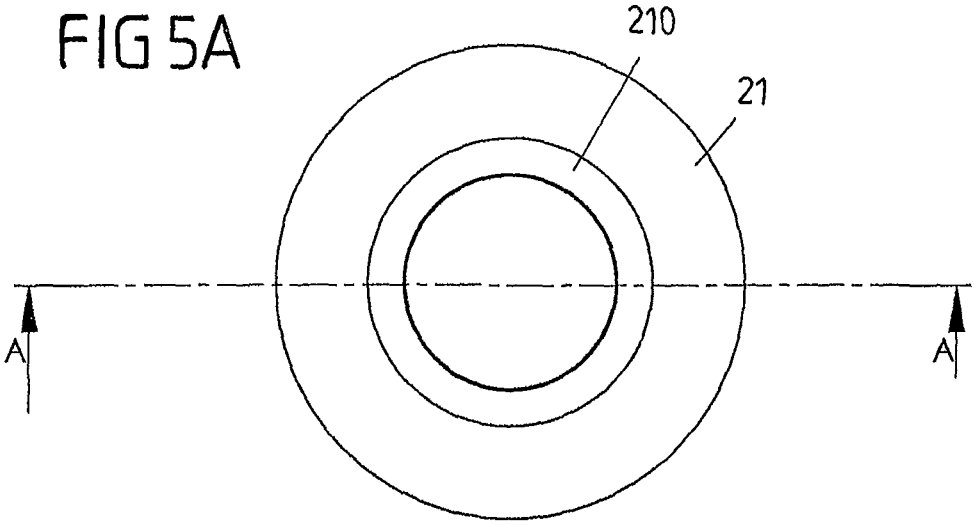
FIG. 5A shows a top view of the locking device in a closing position.
Figure 5B:
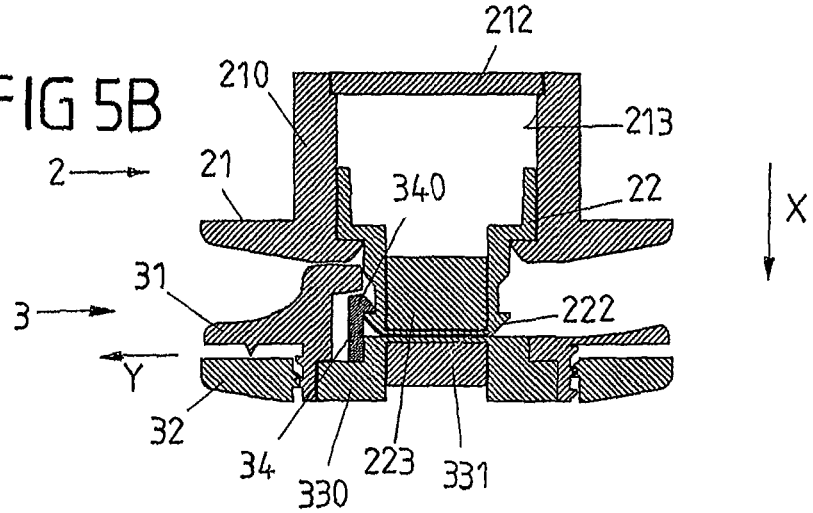
FIG. 5B shows a sectional view of the arrangement according to FIG. 5A along the line A-A.

FIGS. 5A and 5B show the locking device 1 in its closing position, in which the catch sections 222, 340 of the blocking piece 22 and of the spring lock element 34 lockingly engage with each other, so that via the engagement of the blocking piece 22 with the spring lock element 34 the first locking part 2 is held on the second locking part 3 in a mechanically locking manner.

Figure 6A:
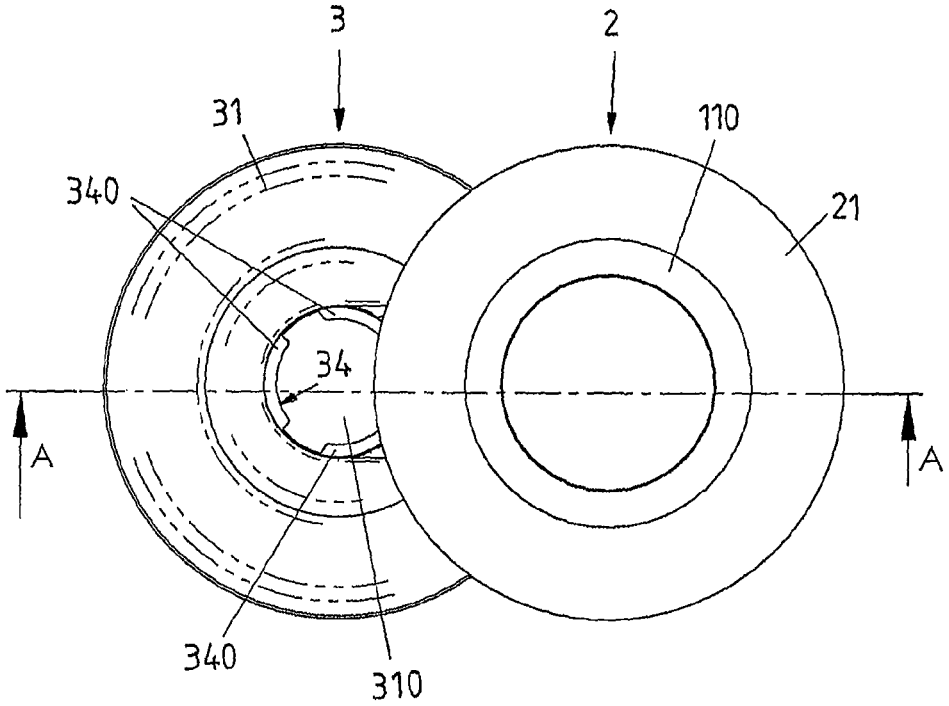
FIG. 6A shows a top view of the locking device in the unlocked state.
Figure 6B:
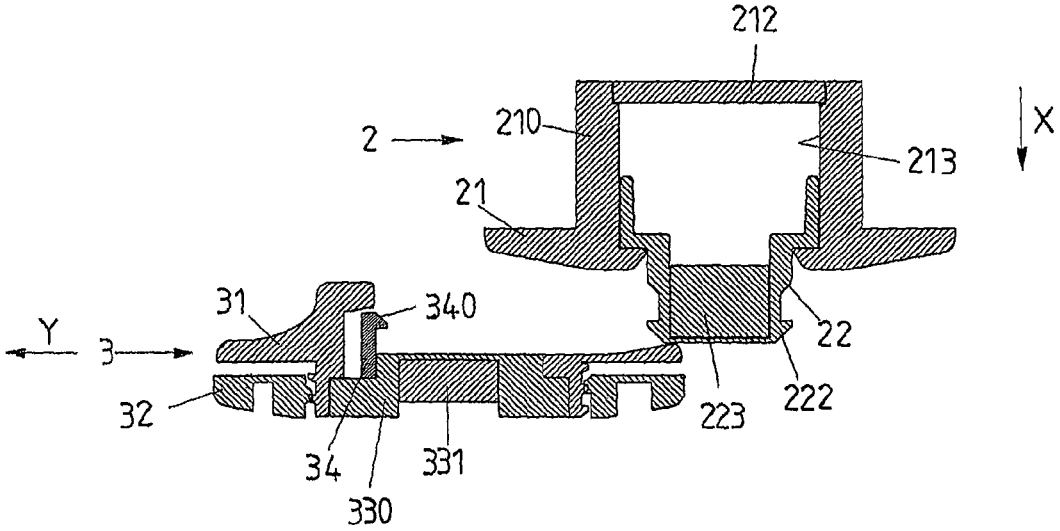
FIG. 6B shows a sectional view of the arrangement according to FIG. 6A along the line A-A.

To open the locking device 1 the blocking piece 22 and the spring lock element 34 are slid relative to each other along the opening direction Y, as illustrated in FIGS. 6A and 6B. For this purpose, the second locking part 3, along with the spring lock element 34, is moved in the opening direction Y relative to the first locking part 2 with the blocking piece 22 arranged on it, so that the blocking piece 22 passes through the circumferential opening 341 on the spring lock element 34 and disengages from the spring lock element 34.

In the unlocked state, illustrated in FIGS. 6A and 6B, the first locking part 2 is no longer held on the second locking part 3, so that the locking parts 2, 3 can be taken away from each other.

By taking out the first locking part 2 from the second locking part 3, moreover, the magnets 223, 331 on the blocking piece 22 or on the casing 31 are removed from each other, so that the magnetic force between these magnets 223, 331 is weakened. When the first locking part 2 is sufficiently far enough removed from the second locking part 3, the magnetic force of the magnets 212, 223, acting between the casing 21 of the first locking part 2 and the blocking piece 22, exceeds the magnetic force of the magnets 223, 331, so that due to the magnetic force between the magnets 212, 223 the blocking piece 22 is pulled towards the magnet 212 on the casing section 210 of the casing 21 of the first locking part 2 and with that is transferred into its retracted position (see FIG. 3B).

In the retracted position, as has been said before, the blocking piece 22 then does not, or at least not obstructively, project outwards from the casing 21, so that the blocking piece 22 is not obstructing the handling of a component, which the first locking part 2 is connected to, and, moreover, is not affecting the aesthetic overall impression of this component (e.g. when used on a handbag or the like).

FIGS. 7 to 12 show a further exemplary embodiment of a locking device 1, which essentially differs from the exemplary embodiment according to FIGS. 1 to 6 in that on a casing 21 of a first locking part 2 two blocking pieces 22*a*, 22*b* and on a casing 31 of a second locking part 3 two spring lock elements 34*a*, 34*b* are provided and thus a double mechanical locking of the locking parts 2, 3 with each other can be established. The same reference signs as before are subsequently assigned to components with the same function, as far as this seems useful.

The first locking part 2 has two blocking pieces 22*a*, 22*b*, which are arranged on a casing section 210 of the casing 21, each in a housing chamber 213*a*, 213*b* respectively. Each blocking piece 22*a*, 22*b* has a catch section 222*a*, 222*b* and supports a magnet 223*a*, 223*b*.

Figure 7:
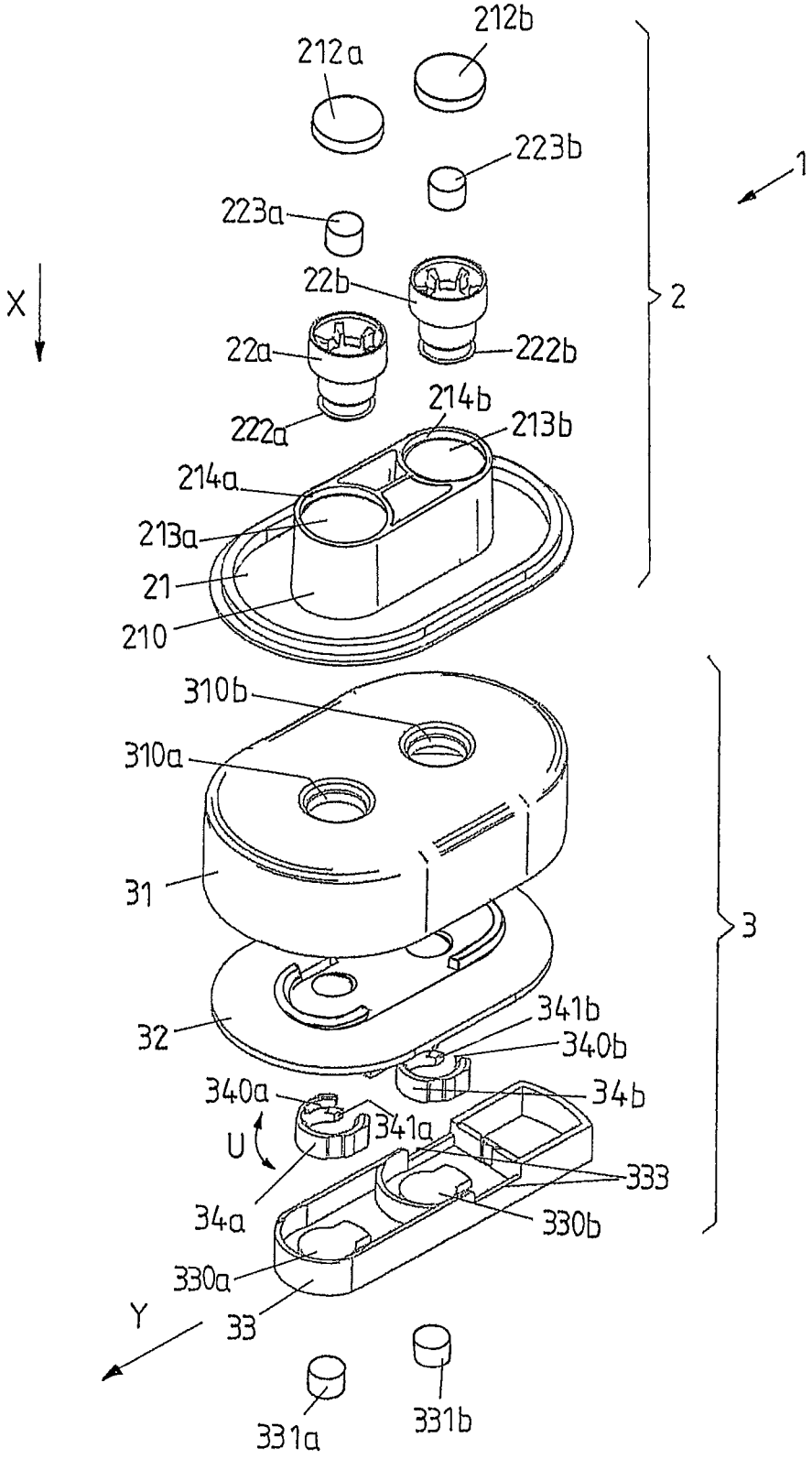
FIG. 7 shows an exploded view of a further exemplary embodiment of a locking device.

A magnet 212*a*, 212*b* is arranged on each of the housing openings 214*a*, 214*b* of the casing section 210, which said magnet 212*a*, 212*b* closes the housing chamber 213*a*, 213*b* on the rear side (i.e. towards a side turned away from the other, second locking part 3 in the closing position) (compare FIG. 7).

The second locking part 3 has a casing 31, onto which a casing part 32 is attached. On the casing part 32, which is rigidly connected to the casing 31, an adjustment element 33 is arranged, which on the one hand supports two spring lock elements 34*a*, 34*b* on holding sections 330*a*, 330*b* in a torque-proof manner and which is, on the other hand, connected to magnets 331*a*, 331*b* via housing openings 232*a*, 232*b*.

Figure 8:
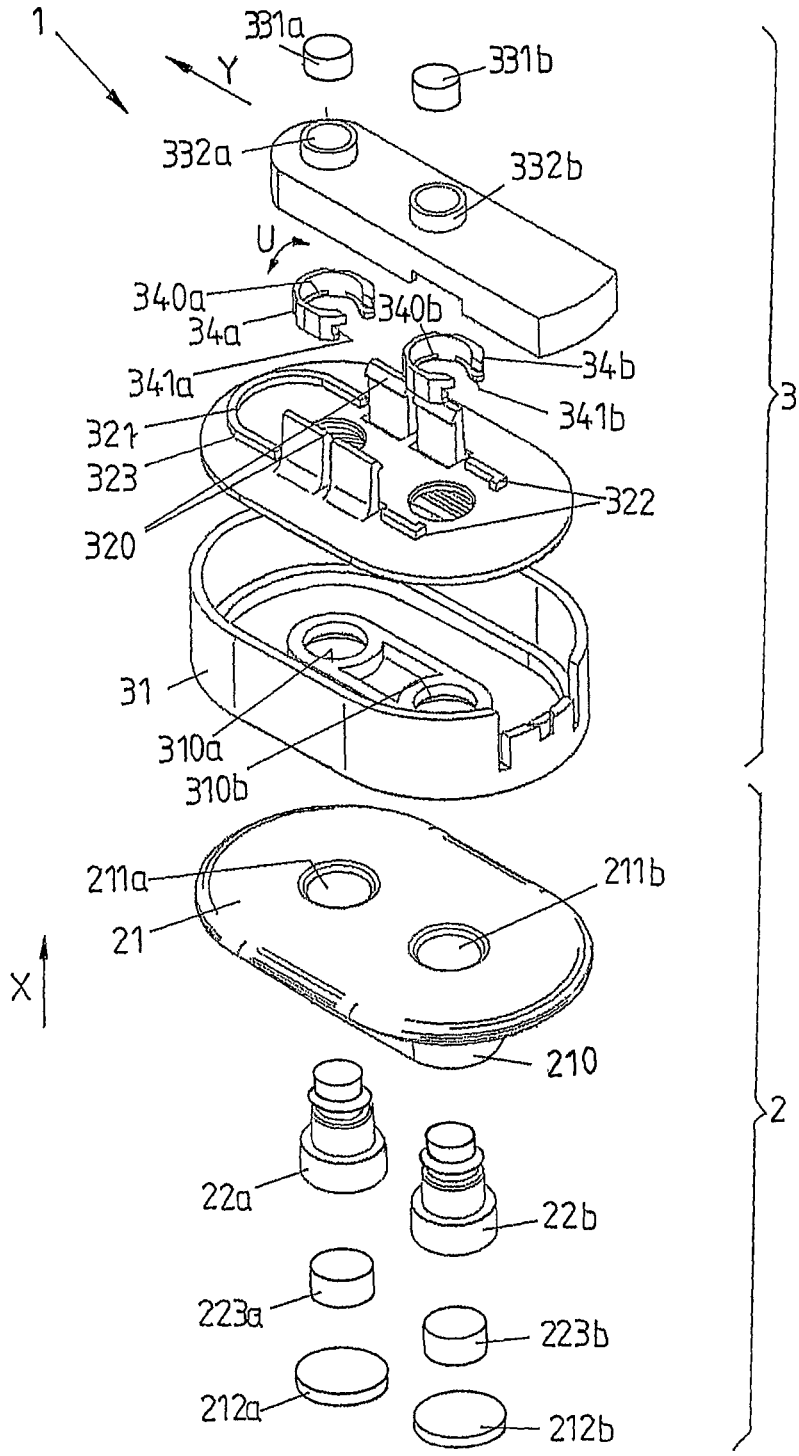
FIG. 8 shows an exploded view of the locking device according to FIG. 7, viewed from a different perspective.

The adjustment element 33 is held slidable along the opening direction Y on the casing part 32 via positive-locking elements 320 and can be slid along longitudinal guiding sections 323 relative to the casing part 32 (see FIG. 8). End positions of the adjustment element 33 are defined along the opening direction Y on the one hand by a stop section 321 and on the other hand by stops 322, which are lying in recesses 333 on the adjustment element 33.

Figure 9A:
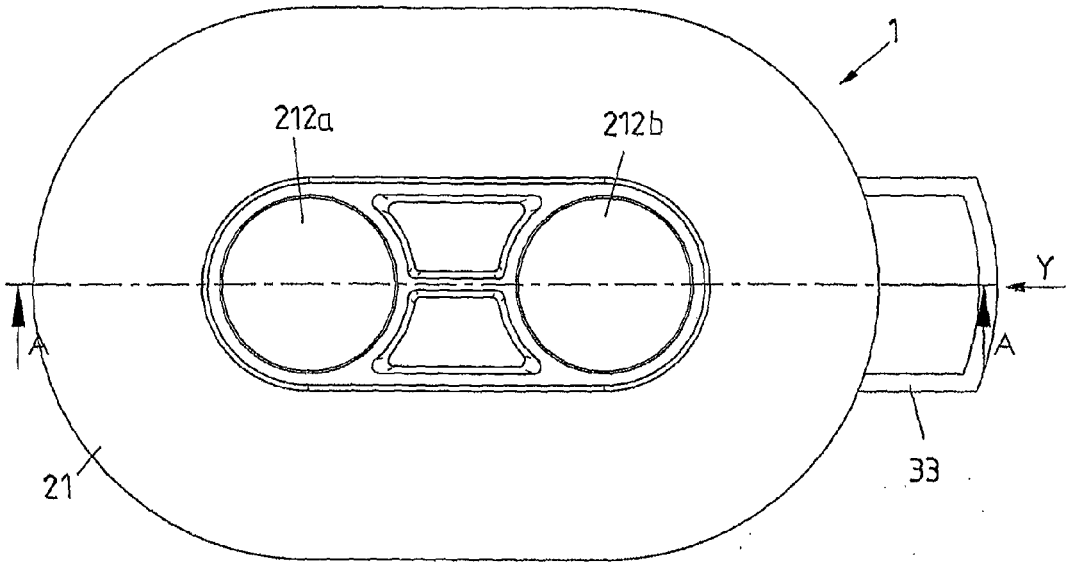
FIG. 9A shows a top view of the locking device prior to closing.
Figure 9B:
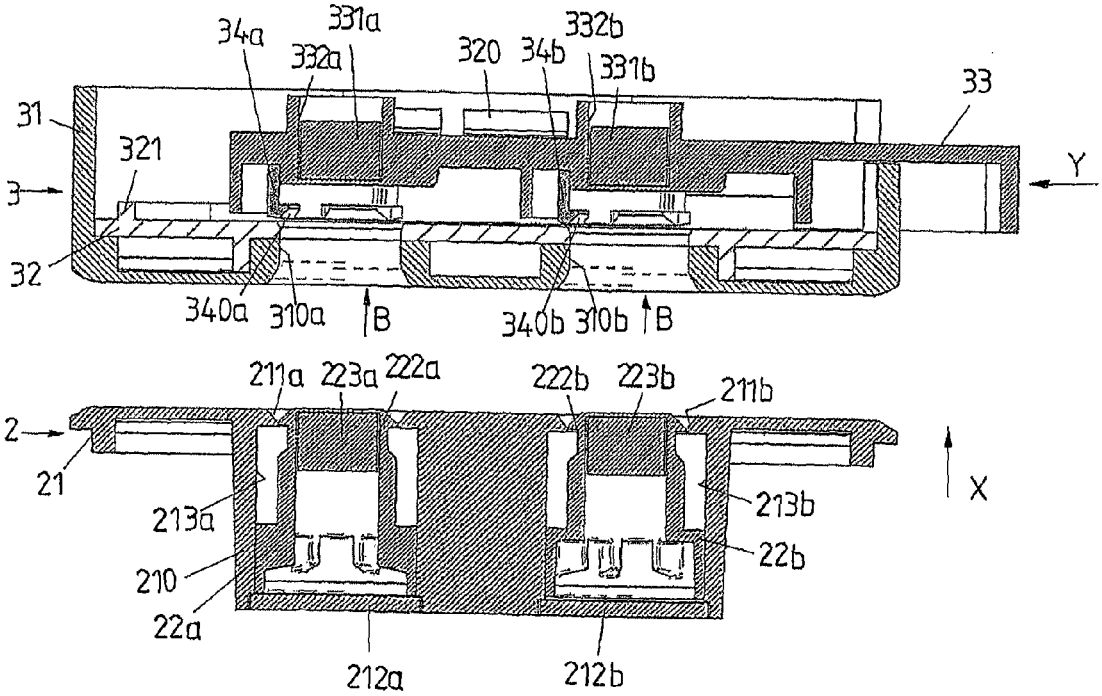
FIG. 9B shows a sectional view of the arrangement according to FIG. 9A along the line A-A.
Figure 10A:
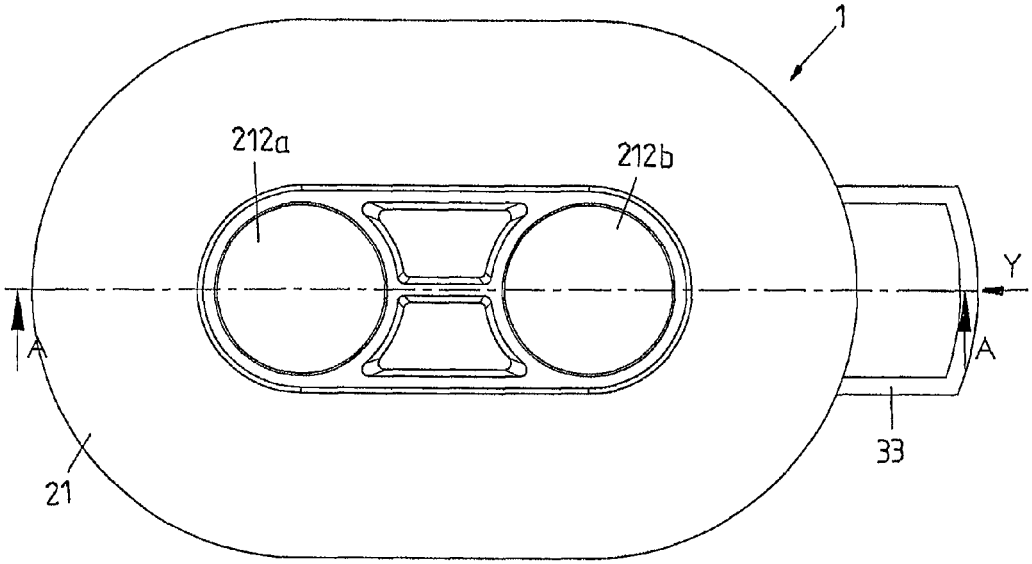
FIG. 10A shows a top view of the locking device prior to closing.
Figure 10B:
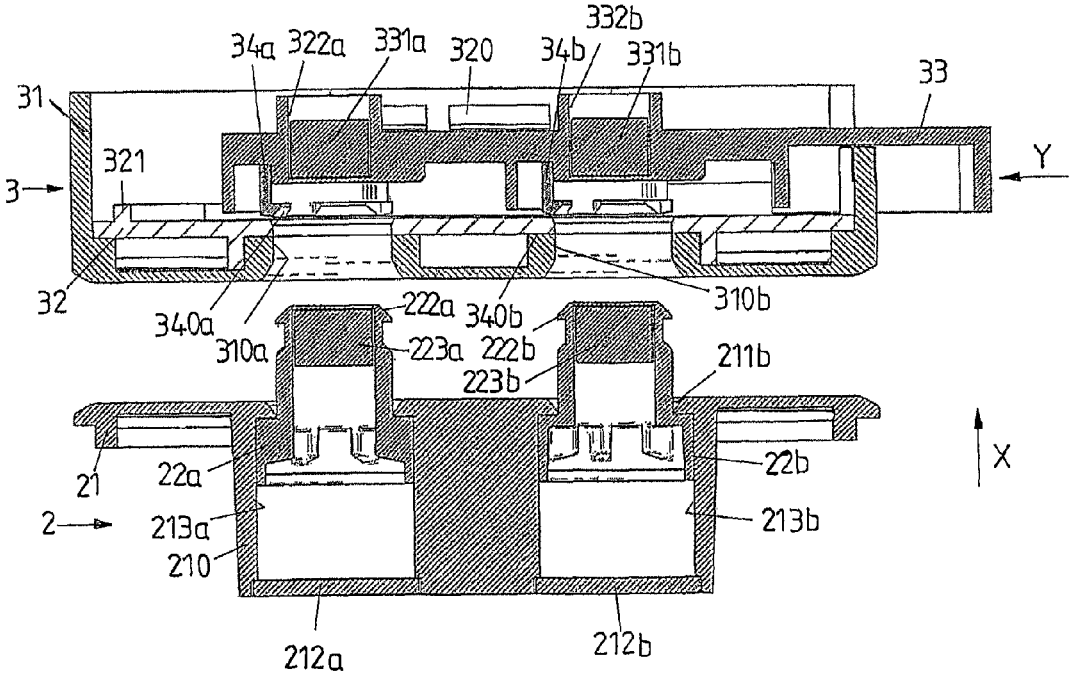
FIG. 10B shows a sectional view of the arrangement according to FIG. 10A along the line A-A.
Figure 11A:
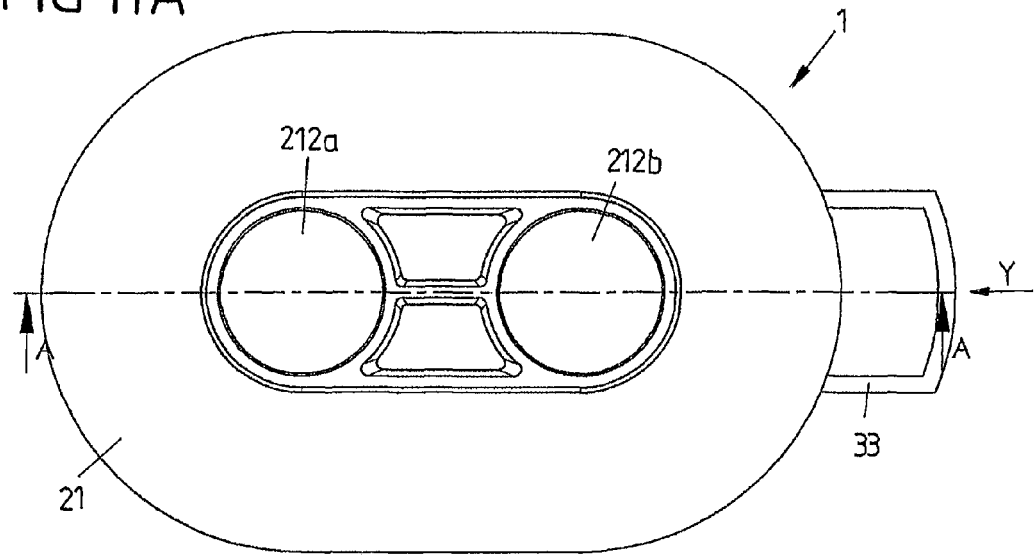
FIG. 11A shows a top view of the locking device in the closing position.
Figure 11B:
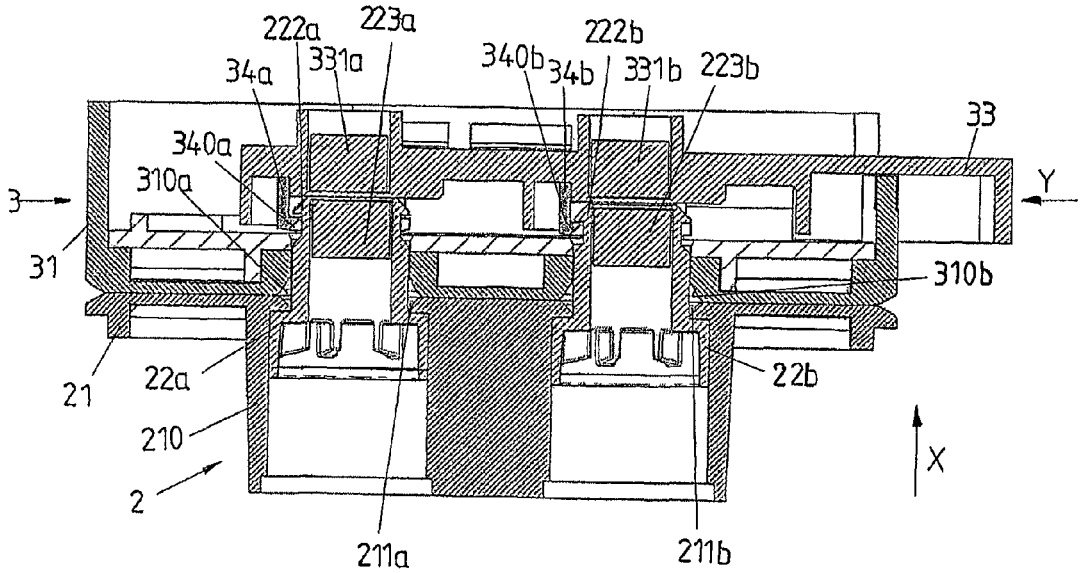
FIG. 11B shows a sectional view of the arrangement according to FIG. 11A along the line A-A.

FIGS. 9A and 9B show the locking device 1 in a state prior to closing. In this state the blocking pieces 22*a*, 22*b* of the first locking part 2 are retracted into the housing chambers 213*a*, 213*b* on the casing section 210 and do not or at least not obstructively project outwards beyond the casing 21. When, analogous to the preceding description for the exemplary embodiment according to FIGS. 1 to 6, the first locking part 2 is brought close to the second locking part 3, the magnetic forces between the magnets 223*a*, 223*b*, 231*a*, 231*b* on the blocking pieces 22*a*, 22*b* on the one hand and on the adjustment element 33 on the other hand have the effect that the blocking pieces 22*a*, 22*b* are transferred from their retracted position into an extended position illustrated in FIGS. 10A and 10B.

In the extended position the blocking pieces 22*a*, 22*b* each extend through the opening 211*a*, 211*b* on the casing 211 respectively and project outwards from the casing 21 in the direction of the second locking part 3.

In this extended position the blocking pieces 22*a*, 22*b* can be inserted in housing openings 310*a*, 310*b* on the casing 31 of the second locking part 3, to be brought into locking engagement with the spring lock elements 34*a*, 34*b*. In the locked state, corresponding to the closing position of the locking device 1 and illustrated in FIGS. 11A and 11B, the catch sections 222*a*, 222*b* of the blocking pieces 22*a*, 22*b* then engage with the catch sections 340*a*, 340*b* of the spring lock elements 34*a*, 34*b*, so that via this engagement the first locking part 2 is held in an engaging, positive-locking manner on the second locking part 3.

Figure 12A:
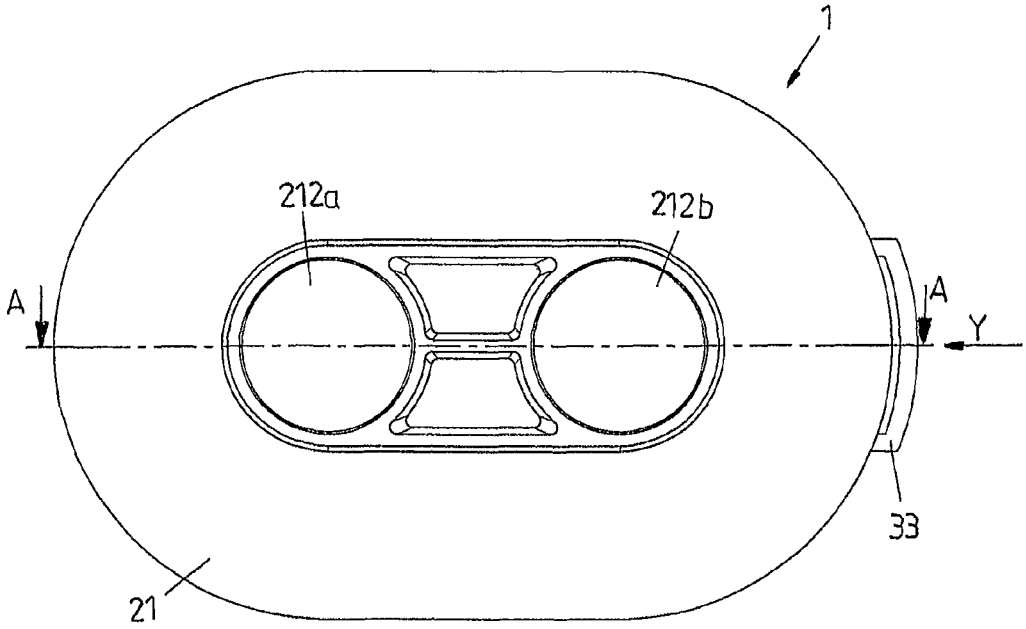
FIG. 12A shows a top view of the locking device in the unlocked state.
Figure 12B:
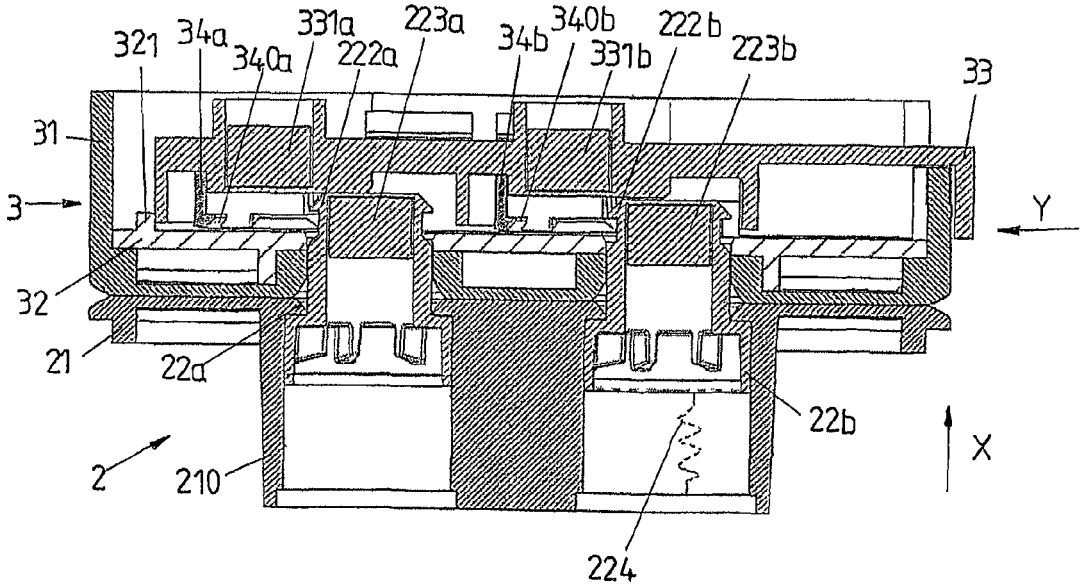
FIG. 12B shows a sectional view of the arrangement according to FIG. 12A along the line A-A.

To open the locking device 1, the adjustment element 33 is moved, along with the spring lock elements 34*a*, 34*b* arranged on it, in the opening direction Y relative to the blocking pieces 22*a*, 22*b*, as illustrated in FIGS. 12A, 12B. The blocking pieces 22*a*, 22*b* are thus moved through circumferential openings 341*a*, 341*b* of the spring lock elements 34*a*, 34*b* and disengage from the spring lock elements 34*a*, 34*b*, so that the lock between the first locking part 2 and the second locking part 3 is terminated and the blocking pieces 22*a*, 22*b* can be taken out of the housing openings 310*a*, 310*b* of the casing 31 of the second locking part 3, to remove the first locking part 2 from the second locking part 3.

As illustrated in FIG. 12B, the adjustment element 33 in the unlocked state lies against the stop section 321 of the casing part 32. This stop section 321 therefore defines an end position for the unlocked state, in which the engagement between the spring lock elements 34*a*, 34*b* and the blocking pieces 22*a*, 22*b* is terminated.

Analogous to the preceding description for the exemplary embodiment according to FIGS. 1 to 6, in the exemplary embodiment according to FIGS. 7 to 12 the blocking pieces are also pre-stressed via magnetic pre-stressing means in the direction of their retracted position against the casing 21. For this purpose, the magnets 223*a*, 223*b* on the blocking pieces 22*a*, 22*b* stand attracting opposite to the magnets 212*a*, 212*b* on the casing section 210, so that, when the first locking part 2 is taken out from the second locking part 3, the blocking pieces 22*a*, 22*b* are returned into their retracted position according to FIG. 9B due to this magnetic returning force.

Instead of magnetic pre-stressing means in the form of the magnet 212 in the embodiment according to FIGS. 1 to 6 or the magnets 212*a*, 212*b* in the embodiment according to FIGS. 7 to 12, a mechanical spring 224 can also be employed, which acts between the blocking piece 22 or the blocking pieces 22*a*, 22*b* and the casing section 210, as schematically illustrated in FIG. 12B for the blocking piece 22*b*. Such a spring 224 causes a mechanical return force, which causes a return of the blocking piece 22 or of the blocking pieces 22*a*, 22*b* into the retracted position, as soon as the returning force exceeds the magnetic force of the magnetic means between the blocking piece 22 and the second locking part 3 or the blocking pieces 22*a*, 22*b* and the second locking part 3.

A locking device of the described kind can for example be employed

- for buttons for clothing;
- for belt buckles (advantage: upon looping in a retracted blocking piece does not get caught on trouser loops);
- for a connection of two pieces of luggage or of modular carrier boxes;
- for a coupling of a piece of luggage or a transport box with a loading area of a vehicle (advantage: heavy boxes do not have to be lifted in order to be unlocked or raised over a multitude of blocking pieces spread out on the loading area);
- for toys, e.g. for the coupling of a toy train.

List of Reference Signs

1 Locking device
2 Locking part
21 Casing
210 Casing section
211, 211*a*, 211*b* Opening
212, 212*a*, 212*b* Magnet
213, 213*a*, 213*b* Housing chamber
214, 214*a*, 214*b* Housing opening
22, 22*a*, 22*b* Blocking piece
222, 222*a*, 222*b* Catch section
223, 223*a*, 223*b* Magnet
224 Spring
3 Locking part

31 Casing
310, 310*a*, 310*b* Housing opening
32 Casing part
320 Positive-locking elements
321 Stop section
322 Stops
323 Longitudinal guiding section
33 Adjustment element
330, 330*a*, 330*b* Holding portion
331, 331*a*, 331*b* Magnet
332, 332*a*, 332*b* Housing opening
333 Recesses
34, 34*a*, 34*b* Spring lock element
340, 340*a*, 340*b* Catch section
341, 341*a*, 341*b* Opening
35 Housing opening
B Direction of movement
U Circumferential direction
X Closing direction
Y Opening direction

The invention claimed is:

1. A locking device, comprising a first locking part, having a casing and a blocking piece arranged on the casing, the blocking piece comprising a first catch section, a second locking part, having a spring lock element which is formed spring-elastic at least in sections and comprises a second catch section, and a magnet device for causing a magnetic force between the blocking piece of the first locking part and the second locking part, and which acts between the blocking piece of the first locking part and the second locking part, wherein to close the locking device the first locking part is attached in a closing direction to the second locking part, whereby the first catch section of the blocking part is passed by the second catch section of the spring lock element by elastically pushing aside the second catch section of the spring lock element, in a closing position the first catch section of the blocking piece and the second catch section of the spring lock element engage with each other, so that the first locking part is locked counter to the closing direction against the second locking part, to release the locking device the spring lock element slides in an opening direction relative to the blocking piece to disengage the spring lock element and the blocking piece, and the blocking piece is arranged movably on the casing of the first locking part in such a way that in a retracted position it is enclosed at least partially in a housing chamber of the casing and in an extended position it projects from the casing in such a way that it is engageable with the spring lock element.

2. The locking device according to claim 1, wherein in the retracted position the blocking piece does not project outwards from the casing.

3. The locking device according to claim 1, wherein the transfer of the blocking piece from the retracted position into the extended position is caused by the magnet device upon attaching the first locking part onto the second locking part.

4. The locking device according to claim 1, wherein the magnet device, acting attractive between the blocking piece, is dimensioned in such a way that upon attaching the first locking part onto the second locking part the blocking piece is held in the extended position for the locking engagement of the blocking piece with the spring lock element.

5. The locking device according to claim 1, wherein the blocking piece is pre-stressed against the casing of the first locking part in the retracted position.

6. The locking device according to claim 5, wherein the blocking piece is pre-stressed against the casing of the first locking part by magnetic pre-stressing means or by a mechanical spring.

7. The locking device according to claim 1, wherein the second locking part has an adjustment element and a casing, wherein the adjustment element is mounted slidable along the opening direction on the casing and supports the spring lock element.

8. The locking device according to claim 7, wherein the magnet device acts between the blocking piece of the first locking part and the adjustment element of the second locking part.

9. The locking device according to claim 1, wherein the spring lock element extends in a circumferential direction around the closing direction and, in the closing position, encompasses the blocking piece in the circumferential direction at least in sections.

10. The locking device according to claim 9, wherein the spring lock element is opened circumferentially in the opening direction.

* * * * *